US009761342B2

(12) United States Patent
Chen et al.

(10) Patent No.: US 9,761,342 B2
(45) Date of Patent: Sep. 12, 2017

(54) METHOD OF PREPARING SILVER-BASED OXIDE ELECTRICAL CONTACT MATERIALS WITH FIBER-LIKE ARRANGEMENT

(75) Inventors: Lesheng Chen, Yueqing (CN); Xiao Chen, Yueqing (CN); Gengxin Qi, Yueqing (CN); Chengfa Mu, Yueqing (CN)

(73) Assignee: Wenzhou Hongfeng Electrical Alloy Co., Ltd., Yueqing, Zhejiang (CN)

( * ) Notice: Subject to any disclaimer, the term of this patent is extended or adjusted under 35 U.S.C. 154(b) by 593 days.

(21) Appl. No.: 13/578,253

(22) PCT Filed: Apr. 11, 2011

(86) PCT No.: PCT/CN2011/000634

§ 371 (c)(1),
(2), (4) Date: Aug. 10, 2012

(87) PCT Pub. No.: WO2012/088736

PCT Pub. Date: Jul. 5, 2012

(65) Prior Publication Data

US 2013/0266468 A1 Oct. 10, 2013

(30) Foreign Application Priority Data

Dec. 30, 2010 (CN) ..... 2010 1 0619920

(51) Int. Cl.

| | |
|---|---|
| ***B22F 3/04*** | (2006.01) |
| ***B22F 3/20*** | (2006.01) |
| ***H01B 1/02*** | (2006.01) |
| ***C22C 5/06*** | (2006.01) |
| ***H01H 1/0237*** | (2006.01) |
| ***B22F 3/24*** | (2006.01) |
| ***B22F 3/10*** | (2006.01) |
| ***B22F 3/14*** | (2006.01) |
| ***C22C 1/10*** | (2006.01) |

(52) U.S. Cl.

CPC ..... *H01B 1/02* (2013.01); *B22F 3/04* (2013.01); *B22F 3/10* (2013.01); *B22F 3/14* (2013.01); *B22F 3/20* (2013.01); *B22F 3/24* (2013.01); *C22C 1/1078* (2013.01); *C22C 1/1084* (2013.01); *C22C 5/06* (2013.01); *H01H 1/0237* (2013.01); *H01H 1/02372* (2013.01); *H01H 1/02374* (2013.01); *H01H 1/02376* (2013.01)

(58) Field of Classification Search

CPC ..... B22F 3/02; B22F 3/04; B22F 3/10; B22F 3/14; B22F 3/20; B22F 3/24; C22C 1/1078; C22C 1/1084; C22C 5/06; H01B 1/02; H01H 1/0237

USPC ..... 419/21

See application file for complete search history.

(56) References Cited

U.S. PATENT DOCUMENTS 4,056,230 A * 11/1977 Decobert ..... B02C 17/18 241/15

FOREIGN PATENT DOCUMENTS

| | | | |
|---|---|---|---|
| CN | 101071687 A | * | 11/2007 |
| CN | 101217074 A | * | 7/2008 |
| CN | 101649399 A | * | 2/2010 |

OTHER PUBLICATIONS

Cobb, Harold M. "Appendix 3: Properties and Conversion Tables." Dictionary of Metals. Materials Park, OH: ASM International, 2012. 346.*

"Carbon—Powder." Carbon—Powder. Goodfellow, Mar. 5, 2016. Web. Mar. 8, 2016.*

"Decarburization." The Great Soviet Encyclopedia, 3rd Edition. 1970-1979. The Gale Group, Inc. Mar. 9, 2016.*

* cited by examiner

*Primary Examiner* — Jessee Roe
*Assistant Examiner* — Anthony Liang

(57) ABSTRACT

A method of preparing silver-based oxide electrical contact materials with fiber-like arrangement, includes the following steps of: (1) uniformly mixing the silver-metal alloy powders and graphite powders and then ball-milling; (2) internally oxidizing the ball-milled powders; (3) sieving; (4) placing the sieved powders and the matrix powders into the powder mixer for mixing; (5) cold-isostatically pressing; (6) sintering; (7) hot-pressing; and (8) hot-extruding, thereby obtaining the silver-based oxide electrical contact material with fiber-like arrangement. The method of the present invention can obtain the silver-based oxide electrical contact material having neat fiber-like arrangement with no specific requirement on processing deformation, plasticity and ductility of the reinforcing phase. The production process in this method is simple and is easy to operate. Besides, there is no particular requirement on the equipment. The method greatly improves the performance of contact materials in aspects of resistance to welding and arc erosion, conductivity, and processing performance.

2 Claims, No Drawings

METHOD OF PREPARING SILVER-BASED OXIDE ELECTRICAL CONTACT MATERIALS WITH FIBER-LIKE ARRANGEMENT

CROSS REFERENCE OF RELATED APPLICATION

This is a U.S. National Stage under 35 USC 371 of the International Application PCT/CN2011/000634, filed 11 Apr. 2011.

BACKGROUND OF THE PRESENT INVENTION

Field of Invention

The field of the invention is that of electrical contact materials, and the invention relates more particularly to a method of preparing silver-based oxide electrical contact materials with fiber-like arrangement.

Description of Related Arts

The rapid development of the electrical industry places an increasingly high requirement for the improvement of the performance of the silver-based electrical contact materials. Therefore, a silver-matrix composite intended for better electrical and mechanical performance has been developed to replace the traditional silver-based contact materials. Furthermore, silver-based oxide composites with fiber-like arrangement which have high resistance to welding and arc erosion and good processing performance have attracted great interests of researchers in recent years. However, silver-based oxide materials have not been widely promoted and applied due to its complex preparation process, high cost, and difficulties involved in the secondary processing. Therefore, the development of a simple and practical method which can be applied to mass production is urgently called for in current research.

By retrieving domestic and foreign research on silver-based oxide electrical contact materials with fiber-like arrangement, a Chinese invention patent is discovered and it is described as follows: Silver-based Electrical Contact Materials with Fiber-like Arrangement and Preparation Method thereof, application number: 200910196283.0, Publication Number: CN101707145A.

At present, there are basically two methods of preparing silver-based oxide electrical contact materials with fiber-like arrangement. The first is the traditional powder metallurgy sintering extrusion method and its modification with improved extrusion for increased processing deformation. The main process is as follows: powder mixing→pressing→sintering→extruding→drawing→annealing→drawing→products. The fiber-like arrangement prepared by this method is not neatly displayed and not suitable for the reinforcing phase with poor plasticity and ductility. Furthermore, large particles of the reinforcing phase may affect product performance. The second method combines the green body pre-design with extrusion. To be more precisely, a certain number of reinforcing phase wire materials are fixed in the matrix by mold in advance, and then isostatic-pressed, sintered and extruded in turn [Literature: CN101707145A]. Although a neat and continuous fiber-like structure can be achieved through this method, it cannot be applied to the large-scale production. There are mainly two reasons: one is that the process is rather complex and requires pre-preparation of the particles reinforcing silver-based wire materials which are to be fixed in the matrix by mold; the other is that the process has specific requirement on the plasticity and ductility of the reinforcing phase wire materials.

SUMMARY OF THE PRESENT INVENTION

With regard to the shortcomings and defects of the prior art, the present invention aims to present a method for preparing silver-based oxide electrical contact materials with fiber-like arrangement which places no particular requirements on processing deformation, plasticity and ductility of the reinforcing phase. The production process in this method is simple and is easy to operate. Besides, there is no particular requirement on equipment. In the method of the present invention, the desired contact material has high resistance to welding and arc erosion, conductivity and improved processing performance.

To achieve the above object, the technical solution adopted by the present invention is described as follows.

The present invention provides a method of preparing silver-based oxide electrical contact materials with fiber-like arrangement comprising the steps of:

(A) uniformly mixing silver-metal-additive alloy powders with graphite powders, and then placing the mixed powders into a high-energy ball milling tank for ball-milling, wherein there are one or more kinds of metals in the alloy powders with better reducibility than that of Ag whichever can form alloy with Ag and are spontaneously oxidizable; the weight ratio of Ag to other metals in the alloy powders is calculated according to the composition of the preparation material and subsequent processing requirements; the weight ratio of the alloy powders to graphite powders is calculated according to the desired looseness of the material, the content of the additive is calculated according to the content of the metal to be oxidized and subsequent processing requirements, and the additive is selected from a group consisting of Bi, In, Cu and rare earth elements;

(B) internally oxidizing the powders obtained from the step (A) comprising firstly decarburized in air atmosphere and then internally oxidized in oxygen atmosphere;

(C) sieving the internally oxidized powders obtained from the step (B), placing large particle powders that fail to pass a sieve into a high-energy ball milling machine for further processing, and then sieving;

(D) placing the composite powders obtained from the step (C) and the matrix silver powders into a powder mixer for mixing, wherein a weight ratio of the composite powders to the matrix silver powders is calculated according to the composition of the preparation material and fiber sizes;

(E) cold-isostatically pressing the powders obtained from the step (D);

(F) sintering the body obtained by cold isostatic pressing;

(G) hot-pressing the body obtained by sintering; and (H) hot-extruding the body obtained by hot-pressing, thereby obtaining the fibrous structural silver-based oxide electrical contact material.

The silver-based oxide electrical contact materials with fiber-like arrangement, prepared by the above method of the present invention, displays a neat fiber-like arrangement of reinforcing phase (oxide) obtained through directional arrangement and interconnection of the particles thereof. The reinforcing phase can be one material or a mixture of several materials depending on the number of metals used in the silver-metal-additive alloy powders of the step (A).

Different from the traditional methods, through which the mechanical alloying and the obvious plastic deformation from processing are combined, or the simple pre-oxidation preparation method, the method of the present invention is described as follows. Firstly, the silver-metal-additive alloy powders and graphite powders are dealt with high energy ball milling for refinement through high energy collision and milling so that the uniform and ultrafine composite powders are obtained. The ball-milled composite powders are then internally oxidized, and the graphite powders in air atmosphere are firstly oxidized to form $CO_2$ gas. Due to the discharge of $CO_2$ gas, the structure of the powders becomes loose. The loose structure at high-pressure oxygen atmosphere is conducive to the further spread of oxygen to the internal of the powders for facilitating the complete oxidation of the metal, and ultimately the silver oxide material with loose structure is formed. Afterwards, the powders with loose structure and the matrix Ag powders are uniformly mixed according to the required material composition formula, and then cold-isostatically pressed, sintered, hot-pressed, and hot-extruded in turn. During the extrusion process, due to the flow of the softened matrix Ag, the particles of the powders with loose structure are slowly open, and directionally arranged along the extrusion direction to form the fiber-like arrangement. By this method, the material could achieve a neat fiber-like reinforcing phase arrangement. Its resistance to arc erosion is increased by 10-20% compared with the same contact materials reinforced by dispersed particles; conductivity along the extrusion direction is increased by 5-10%; resistance to welding is increased by 10-20% and electrical service life is increased by 10-25%. Furthermore, it has excellent processing performance for large-scale production.

DETAILED DESCRIPTION OF THE PREFERRED EMBODIMENT

The following is a more detailed description of the technical solution of the present invention and is only to clarify the technical solution of the present invention within and with no limitation to the scope of the invention, and the scope of protection of the present invention is subject to claims.

The method of the present invention intended for the preparation of silver-based oxide electrical contact material with fiber-like arrangement is suitable for the ordinary preparation to yield silver-based electrical contact materials with neat fiber-like structure with no requirement on the deformation, plasticity and ductility of the reinforcing phase. The production process in this method is simple and is easy to operate. Besides, there is no particular requirement on the equipment.

The silver-based oxide electrical contact material obtained by the present invention has neat fiber-like reinforcing phase (oxide), wherein the fiber-like arrangement of the reinforcing phase (oxide) material is formed through the directional arrangement of the particles thereof. The reinforcing phase (oxide) material can be one type of material or a mixture of a variety of materials depending on the number and ratio of the metal used in the previous silver-metal-additive alloy powders.

In the method of the present invention, the silver-metal-additive alloy powders are atomized and then sieved to obtain alloy powders of the size in the range from 80 to 400 meshes. Other procedures may also be taken to obtain the desired alloy powders.

In the method of the present invention, all the steps such as ball milling, internal oxidating, sieving, powder mixing, cold isostatic pressing, sintering, hot pressing and hot extruding, have optional process operation parameters according to specific processes. One preferred parameter is stated as below:

In the first step, the Ag-metal-additive alloy powders and the graphite powders are uniformly mixed and then placed in a high-energy ball milling tank for milling. The metal can be one or more metals that can conveniently form alloy with silver, have better reducibility than silver, and are spontaneously oxidizable. The additive is selected from the group consisting of Bi, In, Cu and rare earth elements. One preferred parameter is illustrated as below. The weight ratio of silver to metal in the alloy powders is 3-0.5. The weight ratio of the graphite powders to the total weight is 0.5%-3%. The content of the additive metal is calculated according to the weight of its oxide, which is no more than the weight of the reinforcing phase in the silver-based oxides (the metal oxides except the additive oxides). The milling speed ranges from 180 rev/min to 300 rev/min. The milling time is 5-10 hours. The ball-to-powder weight ratio (namely, the weight ratio of bead to powder) is 10-20.

In the second step, the ball-milled powder is internally oxidized which comprises two steps: first decarburization in atmospheric air and then internal oxidation in oxygen atmosphere. The following parameters may be used. The oxidation temperature in air atmosphere is 250° C.-700° C. and the oxidation time is 5-15 hours. The oxidation temperature at high-pressure oxygen is 300° C.-700° C. and the oxidation time is 5-15 hours. The oxygen pressure is 0.5 MPa-3.5 MPa.

In the third step, the internally oxidized powders obtained from the second step are sieved and those large granular powders which fail to pass the sieve are placed in the high-energy ball milling machine for further processing, and then sieved again. The parameters may be used as follows: the milling speed between 180 rev/min-280 rev/min, the milling time between 5-15 hours, the ball to powder weight ratio (namely, the weight ratio of the ball to the powders) 10-20, and the mesh number 100-400 meshes.

In the fourth step, the composite powders and silver powders are placed into the powder mixer for mixing. The weight ratio of the composite powders to the matrix silver powders is calculated according to the composition of the preparation material. The parameters can be used as below: the speed of the powder mixer in the range from 20 rev/min to 40 rev/min, the mixing time is 2-6 hours, and the particle size of the matrix silver powders in the range from 50 to 400 meshes.

In the fifth step, the powders obtained from the fourth step are cold-isostatically pressed. The following parameters can be used. The cold isostatic pressure is between 100 Mpa and 400 Mpa.

In the sixth step, the body obtained by cold isostatic pressing is sintered. The following parameters can be used. The sintering temperature is in the range from 600° C. to 900° C. and the sintering time is between 5 and 10 hours.

In the seventh step, the sintered body is hot-pressed. The following parameters can be used: the hot-pressing temperature 600° C.-850° C., the hot-pressing pressure 200 MPa-700 MPa, and the hot-pressing time 5 min-30 min.

In the eighth step, the hot-pressed body is hot-extruded, thereby obtaining the silver-based oxide electric contact material with fiber-like arrangement. The following parameters can be used: the heating temperature of the body 700° C.-900° C., the extrusion ratio 60-400, the extrusion speed 5-15 cm/min, and the preheating temperature of the extrusion mold 300° C.-500° C.

The detailed technical operations of the present invention are described in the following specifically applied embodiments.

Embodiment 1

Take the preparation of $AgSnO_2(5)In_2O_3(5)$ as an example

Step 1: 1262.5 g Ag—Sn—In alloy powders (which contain additive 262.5 g In, and the weight ratio of Ag to Sn in the alloy is 3:1) with the particle size of 400 meshes are obtained. Ag ingot, Sn ingot and $In_2O_3$ powders are placed in the medium frequency induction furnace to be melted into metal liquid, and then are three-level atomized. The atomized silver powders are sieved through the 400 meshes sieve.

Step 2: The Ag—Sn—In alloy powders obtained from the step 1 and 37.88 g graphite powders are uniformly mixed and then placed in the high-energy ball milling tank for ball-milling at the speed of 300 rev/min for a period of 10 hours. The ball-to-powder weight ratio is 10.

Step 3: The ball-milled powders obtained from the step 2 are internally oxidized which comprises two steps of oxidizing for 15 hours in air atmosphere at the oxidization temperature of 300° C., and then oxidizing for 5 hours in oxygen atmosphere at the oxidization temperature of 700° C. and the oxygen pressure of 0.5 MPa.

Step 4: The internally oxidized powders obtained from the step 3 are sieved. The large particle powders that fail to pass the sieve are returned to the ball mill for processing, and then sieved. The ball milling speed is 200 rev/min, the ball milling time is 12 hours, the ball-to-powder weight ratio is 15 and the sieve mesh is 300 meshes.

Step 5: The composite powders obtained from the step 4 and 200 meshes silver powders are placed into the V-shaped powder mixer for uniformly mixing. The mixing speed is 40 rev/min and the time is 6 hours.

Step 6: The powders obtained from step 3 are placed into the plastic tube with a diameter of 9 cm and a length of 20 cm for cold isostatic pressing at 100 MPa.

Step 7: The cold isostatic pressed body obtained from the step 4 is sintered at the sintering temperature of 900° C. for 5 hours.

Step 8: The sintered body obtained from the step 5 is hot-pressed at the temperature of 850° C. and hot-pressing pressure 300 MPa for 30 minutes.

Step 9: The hot-pressed body is hot-extruded at the hot extrusion temperature of 900° C., the extrusion ratio of 300, the extrusion speed of 5 cm/min, and the preheating temperature of the extrusion mold is 400° C.

In this embodiment, the $AgSnO_2(10)$ material with neat $SnO_2$ and additive oxide $In_2O_3$ with fiber-like arrangement is finally obtained. The $SnO_2$ and additive oxide $In_2O_3$ fiber-like arrangement is formed with directional arrangement and connection of many small $SnO_2$ particles and $In_2O_3$ particles. The desired material has the tensile strength of 288 MPa, the resistivity along the extrusion direction of 2.8μΩ·m and the hardness of 87 HV.

Embodiment 2

Take the preparation of $AgCdO_{12}$ contact material as an example

Step 1: 930 g Ag—Cd—Cu alloy powders (which contain additive 30 g Cu, and the weight ratio of Ag to Cd in the alloy is 1:2) with the particle size of 80 meshes and 4.65 g graphite powders are uniformly mixed and then placed in the high-energy ball milling tank for ball-milling. The ball milling speed is 180 rev/min, the ball milling time is 10 hours, and the ball-to-powder weight ratio is 12.

Step 2: The ball-milled powders obtained from the step 1 are internally oxidized which comprises two steps of oxidizing for 5 hours in air atmosphere at the oxidization temperature of 250° C., and then oxidizing for 5 hours in oxygen atmosphere at the oxidization temperature of 300° C. and the oxygen pressure of 1.5 MPa.

Step 3: The internally oxidized powders obtained from the step 2 are sieved, the large particle powders that fail to pass the sieve are returned to the ball mill for processing, and then sieved. The ball milling speed is 280 rev/min, the ball milling time is 5 hours, the ball-to-powder weight ratio is 20 and the sieve mesh is 100 meshes.

Step 4: The powders obtained from the step 3 and 4691 g silver powders with the particle size of 400 meshes are placed into the V-shaped powder mixer for uniformly mixing. While mixing powders, the speed is 20 rev/min and the time is 4 hours.

Step 5: The powders obtained from the step 4 are placed into the plastic tube with a diameter of 9 cm and a length of 15 cm for cold isostatic pressing at 100 MPa.

Step 6: The cold isostatic pressed body obtained from the step 5 is sintered at the temperature of 750° C. for 9 hours.

Step 7: The sintered body obtained from step 6 is hot-pressed at the temperature of 600° C. and hot-pressing pressure 200 MPa for 20 minutes.

Step 8: The hot-pressed body is hot-extruded into sheets at the hot extrusion temperature of 900° C., the extrusion ratio of 300, the extrusion speed of 10 cm/min, and the preheating temperature of the extrusion mold is 300° C.

In this embodiment, the $AgCdO_{12}$ material with neat CdO fiber-like arrangement is finally obtained. The CdO fiber-like arrangement is formed through directional arrangement and connection of many small CdO particles. The obtained material has the tensile strength of 292 MPa, the resistivity along the extrusion direction of 2.1μΩ·m and the hardness of 83 HV.

Embodiment 3

Take the preparation of AgZnO(8) contact material as an example

Step 1: 1063 g Ag—Zn—Bi alloy powders (which contain additive Bi 63 g, and the weight ratio of Ag to Zn in the alloy is 1:1) with the particle size of 200 meshes and 10 g graphite powders are uniformly mixed and then placed in the high-energy ball milling tank for ball-milling. The ball milling speed is 300 rev/min, the ball milling time is 5 hours, and the ball-to-powder weight ratio is 15.

Step 2: The ball-milled powders obtained from the step 1 are internally oxidized which comprises two steps of oxidizing for 6 hours in air atmosphere at the oxidization temperature of 700° C., and then oxidizing for 12 hours in oxygen atmosphere at the oxidization temperature of 500° C. and the oxygen pressure of 1 MPa.

Step 3: The internally oxidized powders obtained from the step 2 are sieved, the large particle powders that fail to pass the sieve are returned to the ball mill for processing, and then sieved. The ball milling speed is 180 rev/min, the ball milling time is 15 hours, the ball-to-powder weight ratio is 10 and the sieve mesh is 400 meshes.

Step 4: The composite powders obtained from the step 3 and 6595 g silver powders with the particle size of 50 meshes are placed into the V-shaped powder mixer for uniformly mixing. While mixing powders, the speed is 30 rev/min and the time is 2 hours.

Step 5: The powders obtained from the step 4 are placed into the plastic tube with a diameter of 9 cm and a length of 30 cm for cold isostatic pressing at 400 MPa.

Step 6: The cold isostatic pressed body obtained from the step 5 is sintered at the sintering temperature of 600° C. for 8 hours.

Step 7: The sintered body obtained from the step 6 is hot-pressed at the temperature of 830° C. and hot-pressing pressure 700 MPa for 5 minutes.

Step 8: The hot-pressed body is hot-extruded into sheets at the hot extrusion temperature of 700° C., the extrusion ratio of 60, the extrusion speed of 15 cm/min, and the preheating temperature of the extrusion mold is 500° C.

In this embodiment, the AgZnO(8) material with neat ZnO fiber-like arrangement is finally obtained. The ZnO fiber-like arrangement is formed through directional arrangement and connection of many small ZnO particles. The obtained material has the tensile strength of 285 MPa, the resistivity along the extrusion direction of 2.0μΩ·m and the hardness of 86 HV.

Embodiment 4

Take the preparation of Ag-4ZnO-8$SnO_2$ contact material as an example

Step 1: 950 g Ag—Zn—Sn alloy powders (which contain additive 30 g In and 20 g Ce, and the weight ratio of Ag to Zn to Sn in the alloy is 1:0.51:1) with the particle size of 200 meshes and 18 g graphite powders are uniformly mixed and then placed in the high-energy ball milling tank for ball-milling. The ball milling speed is 280 rev/min, the ball milling time is 10 hours, and the ball-to-powder weight ratio is 20.

Step 2: The ball-milled powders obtained from the step 1 are internally oxidized which comprises two steps of oxidizing for 6 hours in air atmosphere at the oxidization temperature of 450° C., and then oxidizing for 15 hours in oxygen atmosphere at the oxidization temperature of 500° C. and the oxygen pressure of 3.5 MPa.

Step 3: The internally oxidized powders obtained from the step 2 are sieved, the large particle powders that fail to pass the sieve are returned to the ball mill for processing, and then sieved. The ball milling speed is 280 rev/min, the ball milling time is 15 hours, the ball-to-powder weight ratio is 20 and the sieve mesh is 400 meshes.

Step 4: The composite powders obtained from the step 3 and 4644 g silver powders with the particle size of 300 meshes are placed into the V-shaped powder mixer for uniformly mixing. While mixing powders, the speed is 30 rev/min and the time is 4 hours.

Step 5: The powders obtained from step 4 are placed into the plastic tube with a diameter of 9 cm and a length of 15 cm for cold isostatic pressing at 300 MPa.

Step 6: The cold isostatic pressed body obtained from step 5 is sintered at the sintering temperature of 800° C. for 10 hours.

Step 7: The sintered body obtained from step 6 is hot-pressed at the temperature of 850° C. and hot-pressing pressure 700 MPa for 10 minutes.

Step 8: The hot-pressed body is hot-extruded into sheets at the hot extrusion temperature of 900° C., the extrusion ratio of 400, the extrusion speed of 5 cm/min, and the preheating temperature of the extrusion mold is 500° C.

In this embodiment, the Ag-4ZnO-8$SnO_2$ material with neat ZnO and $SnO_2$ fibrous structures is finally obtained. The ZnO and $SnO_2$ fiber-like arrangement is respectively formed through directional arrangement and connection of many small ZnO and $SnO_2$ particles. The obtained material has the tensile strength of 260 MPa, the resistivity along the extrusion direction of 2.2μΩ·m and the hardness of 88 HV.

It should be understood that the embodiments presented above can only be taken as examples of the invention and are not intended to represent any restrictions for or limitations to the technical scope of the present invention. The present invention can be applied to the preparation of other silver-based oxide composites with fibrous structure by different composition ratio. Any modification within the principles of the present invention, equivalent replacement, and improvement shall be included within the scope of protection of the present invention.

What is claimed is:

1. A method of preparing silver-based oxide electrical contact materials with fiber-like arrangement, comprising the steps of:

(A) uniformly mixing silver-metal-additive alloy powders with graphite powders, and then ball-milling after placing the mixed powders into a high-energy ball milling tank in such a manner that the alloy powders and the graphite powders are refined to form uniform and ultrafine composite powders, wherein the metal in the alloy powders is able to form alloy with Ag, a reducibility of the metal is better than a reducibility of Ag and the metal is spontaneously oxidizable, a weight ratio of Ag to other metals in the alloy powders is calculated according to a composition of the preparation material and subsequent processing requirements, a weight ratio of the alloy powders to the graphite powders is calculated according to a looseness of the silver-based oxide electric contact materials, a content of the additive is calculated according to a content of the metal and subsequent processing requirements, and the additive is selected from a group consisting of Bi, In, Cu and rare earth elements, wherein in step (A), a particle size of the alloy powders is in the range from 80 to 400 meshes; a weight ratio of Ag to metal in the alloy powders is in the range from 3 to 0.5; a content of the graphite powders in the mixed powders is in the range from 0.5% to 3%; a content of the additive metal is based on the requirement that a weight of the metal oxide thereof is no more than that of an reinforcing phase in a silver-based oxide; the additive is selected from a group consisting of Bi, In, Cu and rare earth elements, a ball-milling speed is 180 to 300 rev/min, a ball-milling time 5-10 hours and a ball-to-powder weight ratio 10-20;

(B) internally oxidizing the powders obtained from the step (A) comprising firstly decarburizing in air atmosphere and then internally oxidizing in oxygen atmosphere, wherein in step (B), the internal oxidization comprises two steps of firstly oxidizing for 5-15 hours in air atmosphere at an oxidization temperature of 250-700° C., and then oxidizing for 5-15 hours in oxygen atmosphere at an oxidization temperature of 300-700° C. and an oxygen pressure of 0.5-3.5 MPa, in such a manner the graphite powders in air atmosphere are firstly oxidized to form $CO_2$ gas, a structure of the powders becomes loose due to a discharge of the $CO_2$ gas, the loose structure in oxygen atmosphere is beneficial to a further spread of oxygen to an internal of the powders for promoting a complete oxidation of the metal, and ultimately a silver oxide material with the loose structure is formed;

(C) sieving the internally oxidized powders obtained from the step (B), ball-milling after placing large particle powders that fail to pass a sieve into a high-energy ball milling machine, and then sieving again, wherein in step (C), a speed of the high-energy ball milling is 180-280 rev/min, a milling time is 5-15 hours, a ball-to-powder weight ratio is between 10-20, and a sieve mesh is 100-400 meshes;

(D) uniformly mixing after placing the composite powders obtained from step (C) and matrix silver powders into a powder mixer, wherein a weight ratio of the composite powders to the matrix silver powders is calculated according to a composition of the preparation material and a desired fiber size, wherein in step (D), a speed of the powder mixer is 20-40 rev/min, a mixing time is 2-6 hours, and a particle size of the matrix silver powders is 50-400 meshes;

(E) cold-isostatically pressing the powders obtained from step (D), wherein in step (E), a cold isostatic pressure is 100-400 MPa;

(F) sintering the body obtained by cold isostatic pressing, wherein in step (F), a sintering temperature is 600-900° C., and a sintering time is 5-10 hours;

(G) hot-pressing the body obtained by sintering, wherein in step (G), a hot-pressing temperature is 600-850° C., a hot-pressing pressure is 200-700 MPa, and a hot-pressing time is 5-30 min; and (H) hot-extruding the body obtained by hot-pressing, thereby obtaining the fibrous structural silver-based oxide electrical contact material, wherein in step (H), a heating temperature of the body is 700-900° C., an extrusion ratio is 60-400, an extrusion speed is 5-15 cm/min, a preheating temperature of an extrusion mold is 300-500° C., and during the hot-extrusion process, due to a flow of the matrix silver powders, particles of the powders with the loose structure are slowly opened and directionally arranged along a hot-extrusion direction for forming the fibrous structure.

2. The method of preparing silver-based oxide electrical contact materials with fiber-like arrangement according to claim 1, wherein the silver-based oxide electrical contact material with fiber-like arrangement has a neat fiber-like reinforcing phase which is formed through directional arrangement and connection of particles thereof, and whether the reinforcing phase be one or more materials depends on the kinds and proportion of unoxidized metal in the silver-metal-additive alloy powders in step (A).

* * * * *